US005979193A

United States Patent [19]

Murata

[11] Patent Number: 5,979,193

[45] Date of Patent: Nov. 9, 1999

[54] METHOD OF KNITTING PLATING STITCH AND KNIT FABRIC

[75] Inventor: Kenshi Murata, Kanazawa, Japan

[73] Assignee: Tsudakoma Kogyo Kabushiki Kaisha, Kanazawa, Japan

[21] Appl. No.: 08/729,529

[22] Filed: Oct. 11, 1996

[30] Foreign Application Priority Data

Oct. 13, 1995 [JP] Japan ..... 7-265845

[51] Int. Cl.[6] ..... D04B 1/10

[52] U.S. Cl. ..... 66/169 R; 66/60 R

[58] Field of Search ..... 66/201, 136, 137, 66/20, 22, 23, 25, 36, 40, 215, 75.1, 180, 182, 196, 198

[56] References Cited

U.S. PATENT DOCUMENTS

| | | | |
|---|---|---|---|
| 2,100,861 | 11/1937 | Lochhead | 66/198 |
| 2,150,773 | 3/1939 | Lawson et al. | 66/201 |
| 3,004,412 | 10/1961 | Belford | 66/201 |
| 4,034,581 | 7/1977 | Swafford | 66/136 |

FOREIGN PATENT DOCUMENTS

| | | |
|---|---|---|
| 1-12855 | 3/1989 | Japan . |
| 3-21661 | 3/1991 | Japan . |
| 5-78960 | 3/1993 | Japan . |
| 5-321101 | 12/1993 | Japan . |
| 236974 | 7/1925 | United Kingdom . |

OTHER PUBLICATIONS

Melliand Textilberichte, vol. 65, No. 7, pp. 457–461, Jul. 1984, Dieter Tollkuhn, "Intarsien–Musterung Mit Modernem Intarsien–Jacquard–Umhange–Automaten".

Industrie Textile, vol. 1143, pp. 37–42, Apr. 1984, "Les Possibilites De Dessins Intarsia Sur Rectilignes".

*Primary Examiner*—John J. Calvert
*Assistant Examiner*—Larry D. Worrell, Jr.
*Attorney, Agent, or Firm*—Oblon, Spivak, McClelland, Maier & Neustadt, P.C.

[57] ABSTRACT

A method of knitting a knit fabric which is knitted by a flat knitting machine with a plurality of yarn carriers having the following steps: (a) knitting the first half knitting portion of a course to a plating stitch with a first ground yarn and a plating yarn; (b) knitting the second half knitting portion of the course to a plating stitch with a second ground yarn and the plating yarn; (c) knitting the first half knitting portion of a next course to be coupled with the course to a plating stitch with the second ground yarn and the plating yarn; and (d) knitting the second half knitting portion of said next course to a plating stitch with the first ground yarn and the plating yarn.

7 Claims, 5 Drawing Sheets

METHOD OF KNITTING PLATING STITCH AND KNIT FABRIC

BACKGROUND OF THE INVENTION

1. Field of the Invention

The present invention relates to a method of knitting a plating stitch capable of forming a clear colored pattern and a knit fabric.

2. Description of the Prior Art

A colored design can be knitted by a plating stitch using a flat knitting machine having a plurality of yarn carriers which can be driven independently of one another and through which threads reciprocatingly move to the right and the left (for example, Japanese Unexamined Patent Publication No. 5-321101). The term "plating stitch" used hereinafter is defined as a method of knitting carried out using two types of different threads each having a different color, gloss, thickness, twist and fiber material wherein one of the threads appears on a front side and the other appears on a back side.

For example, when a knit fabric A as shown in FIG. 5 is to be knitted, a plainly stitched structure portion A1 is knitted by an plating yarn "c" only at the first half portion of a first right-going course C1. The platingly stitched portion A2 of the plainly stitched structure is knitted by a ground yarn "a" and the plating yarn "c" in the second half portion of the first course C1. A similar platingly stitched portion A2 is knitted in the first half portion of a next left-going course C2, the plainly stitched structure portion A1 is knitted by the plating yarn "c" only in the second half portion of the next course C2 and the same procedure is repeated thereafter.

As a result, there can be knitted the knit fabric A having a colored pattern and design arranged such that the plating yarn "c" and the ground yarn "a" appear to the surface of the plainly stitched structure portion A1 and the platingly stitched portion A2, respectively. Since this knitting method can continuously form the plainly stitched structure over the entire portion of the respective courses C1 and C2 and thus since it is sufficient only to cause all the needles to carry out knitting operation, the method has high productivity and there is no possibility that a defect in the outside appearance of the stitched structure occurs at the boundary A0 between the plainly stitched structure portion A1 and the platingly stitched portion A2.

It should be noted that in FIG. 5, the symbols (c, a) in the second half portion of the right-going course C1 and the symbols (a, c) in the first half portion of the next left-going course C2 shows the plating stitch made by the ground yarn "a" and the plating yarn "c". The reason why the symbols a and c are reversed in those courses is that a thread fed from the yarn carrier preceding a knitting direction appears to a front stitch and a thread fed from the thread feed port following the above thread feed port appears to a back stitch in the plating stitch. Further, arrows shown in the respective courses C1, C2 show the directions in which the respective courses C1, C2 are knitted and symbol trains Ω, Ω . . . Ω written parallel to the straight lines showing the respective courses C1, C2 show that the needles for knitting the respective courses C1, C2 carry out knitting operation.

In the above noted prior art, since the plainly stitched structure portion and the platingly stitched portion forming the colored pattern of the knit fabric. The plainly stitched structure portion is knitted by the plating yarn only and the plating stitch of the latter is formed by the ground yarn and the plating yarn. As a result, there is a drawback that since the thickness the platingly stitched portion of the knit fabric forming the colored pattern is different twice as compared with that of the plainly stitched structure portion, the range to which the knit fabric is applied is limited. Further in the case where the thickness of the ground yarn is reduced to flatten the variation of the thickness of the knit fabric by extremely thinning the size of the ground yarn, it is difficult to completely cover the plating yarn with the ground yarn and it is observed that the plating yarn is mixed with the front stitch of the platingly stitched portion, there is a possibility that the tone of color of a colored pattern is lowered.

SUMMARY OF THE INVENTION

Taking the above problems of the prior art into consideration, an object of the present invention is to provide a method of knitting plating stitch and a knit fabric for eliminating the change in thickness of a knit fabric at the respective portions thereof where colored patterns are formed by a common plating yarn by causing platingly stitched portions to locate adjacent to each other and permit the colored patterns to be realized in a clear tone of color.

To achieve the above object according to this invention, a method of knitting a plating stitch is utilized to form a knit fabric by a flat knitting machine with a plurality of yarn carriers, wherein the first half knitting portion of a course is knitted to a plating stitch with a first ground yarn and a plating yarn, the second half knitting portion of the course is knitted to a plating stitch with a second ground yarn and the plating yarn, the first half knitting portion of a next course to be coupled with the above course is knitted to a plating stitch with the second ground yarn and the plating yarn, and the second half knitting portion of the next course is knitted to a plating stitch with the first ground yarn and the plating yarn.

It may be appreciated that the boundaries between the first half knitting portions in the course and the next course and the second half knitting portions therein can be located at the same position in a wale direction or at different positions in the wale direction.

The terms wale direction and course direction used throughout this description are defined as follows:

The course direction corresponds to a direction parallel to the movement direction of the yarn carrier. The wale direction is defined as a direction perpendicular to the wale direction.

According to the above knitting method, the first half knitting portion of the course and the second half knitting portion of the next course are knitted to the plating stitch with the first ground yarn and the plating yarn. The second half knitting portion of the course and the first half knitting portion of the next course are knitted to the plating stitch with the second ground yarn and the plating yarn which is common to the above plating yarn. The respective knitted portions can be formed to the design of a colored pattern with the first and second ground yarns appearing to a front stitch.

When the boundaries between the respective first half portions in the course and the next course and the respective second half portions therein are located at the same position, a vertically-striped pattern can be formed in the wale direction. In addition, when the boundaries are regularly shifted in the wale direction by the predetermined number of stitches, an obliquely-striped pattern and a diamond-shaped pattern can be knitted. Furthermore, when the stitches are smoothly varied and located at different positions, a water-flow-shaped vertically-striped pattern can be knitted.

The knit fabric according to the present invention for achieving the above object comprises a first platingly stitched portion knitted with a first ground yarn and an plating yarn and a second platingly stitched portion adjacent to the first platingly stitched portion in a flat direction and knitted with a second ground yarn and the plating yarn, wherein the first and second platingly stitched portions are coupled with each other in a course direction through the plating yarn.

It may be appreciated that the first and second platingly stitched portions form a continuous plainly stitched structure.

According to the above knit fabric, since the first ground yarn and the second ground yarn appear to a front stitch in the adjacent first and second platingly stitched portions, respectively, the design of a colored pattern with a clear color tone can be formed. Further, since the first and second platingly stitched portions are coupled with each other in the course direction through the common plating yarn and the first and second ground yarns appearing to the respective front stitches are perfectly separated from each other in the course direction, the respective portions forming the colored pattern substantially form an intersia pattern.

When the first and second platingly stitched portions are knitted by the continuous plainly stitched structure, since there is no variation of a knitted structure therebetween, the knit fabric can be knitted to a uniform structure as a whole.

Note that the knitting mentioned in the above passages is to be executed by the flat knitting machine with a plurality of the independently operable yarn carriers and the flat knitting machine described in, for example, Japanese Examined Patent Publication No. 1-12855 may be used as the flat knitting machine for this purpose.

These and other objects, features and advantages of the invention will become more apparent upon reading the detailed description of the preferred embodiment with reference to the appended drawings.

DETATLED DESCRIPTION OF THE PREFERRED EMBODIMENTS

Figure 1:
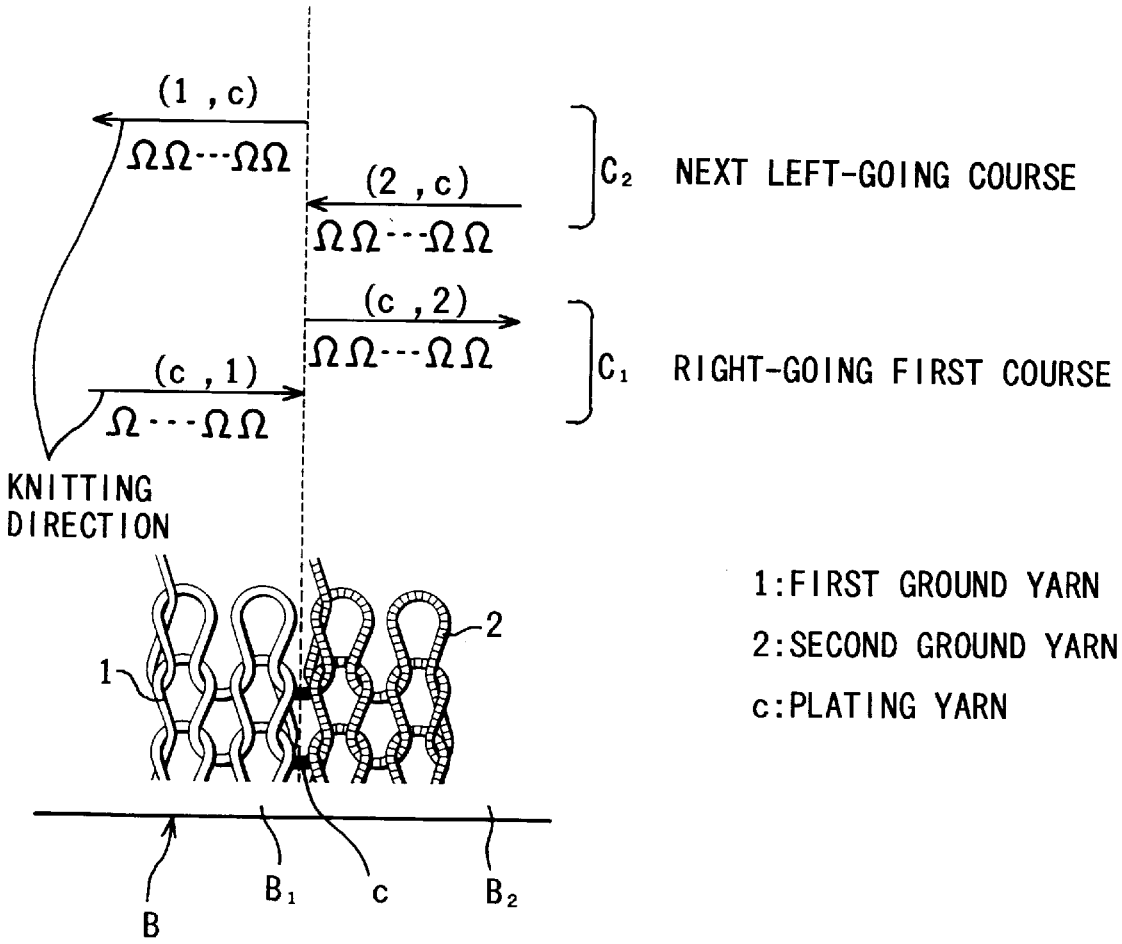
FIG. 1 is a schematic view showing an embodiment of a knitting method of the present invention.

In FIG. 1, a knit fabric B is composed of a first platingly stitched portion B1 and a second platingly stitched portion B2 which are adjacent to each other.

Figure 5:
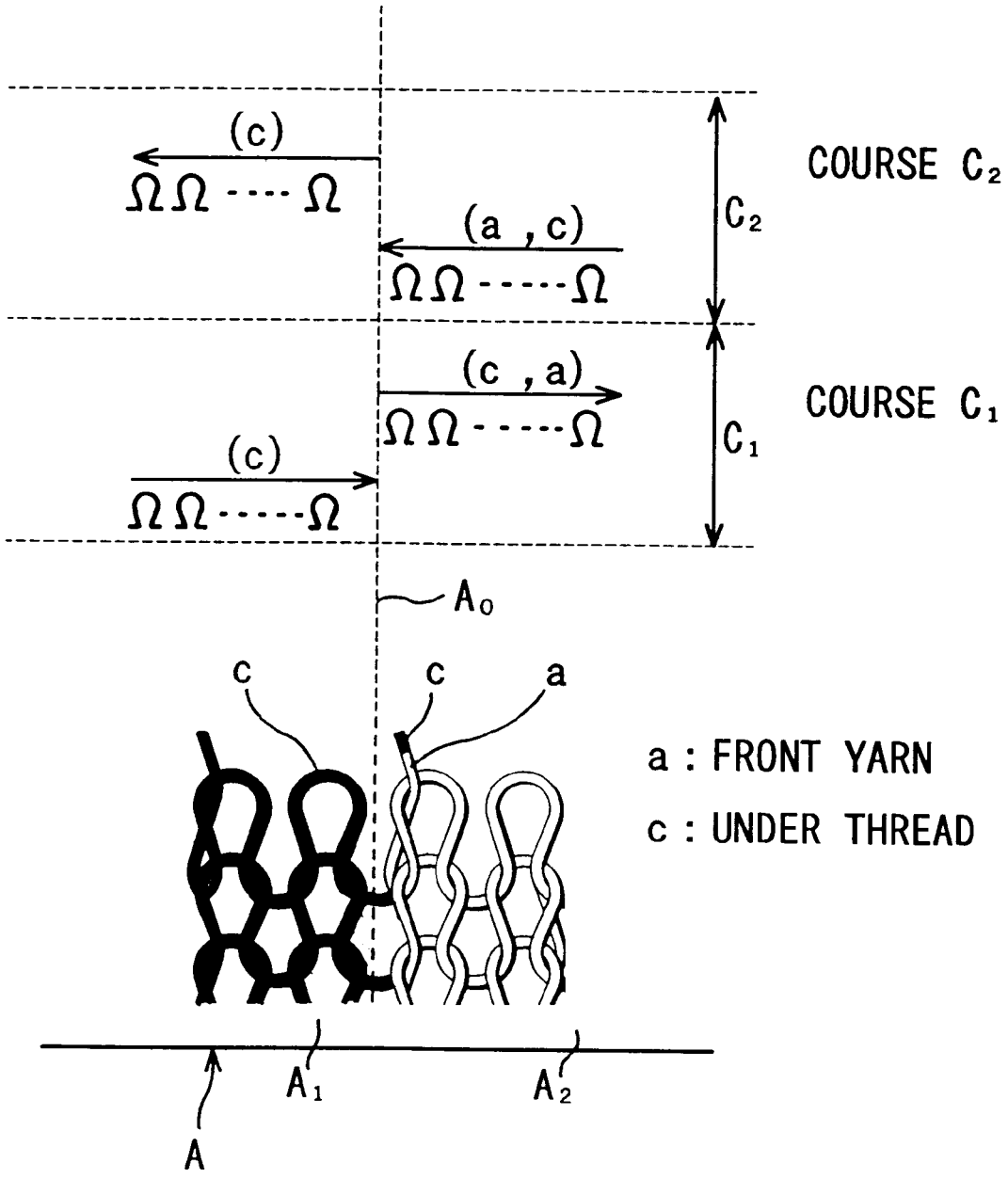
PRIOR ART FIG. 5
FIG. 5 is a view equivalent to FIG. 1 showing a conventional knitting method.

More specifically, the first platingly stitched portion B1 is knitted to a plating stitch of a plainly stitched structure by a first ground yarn 1 and an plating yarn "c". Further, the second platingly stitched portion B2 is knitted to a plating stitch of the plainly stitched structure by a second ground yarn 2 and a plating yarn "c" common to the above plating yarn "c". However, the knitting method of FIG. 1 is expressed in accordance with the method of expression shown in FIG. 5.

Figure 2A:
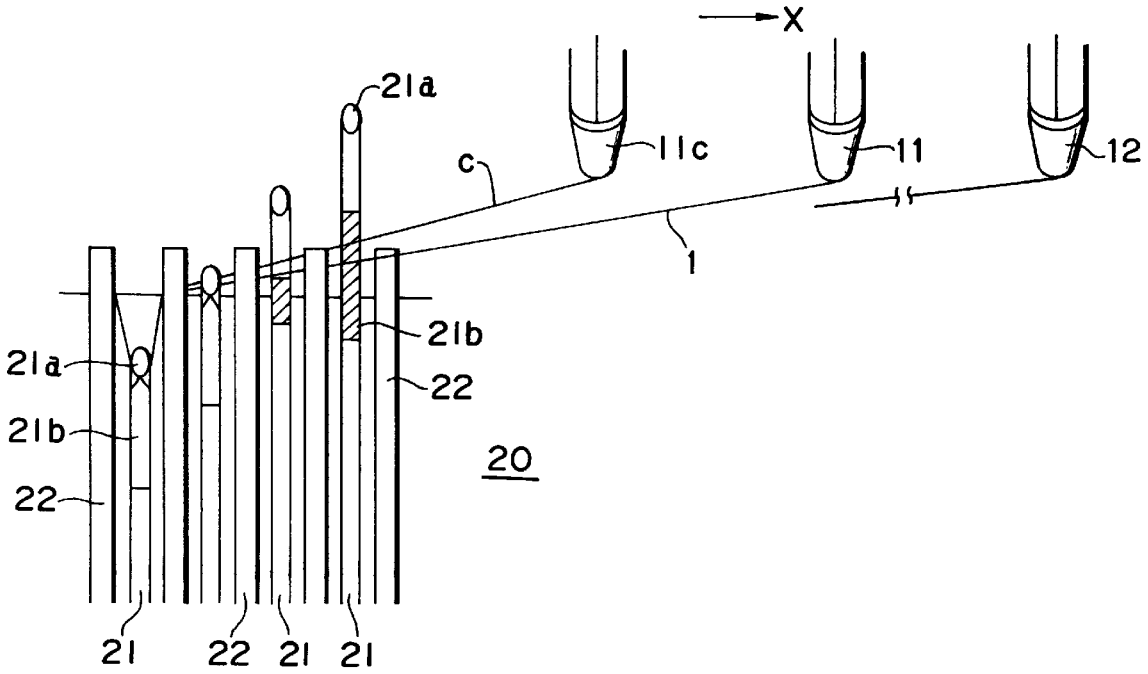
FIG. 2A is a view showing the arrangement of the main portion of a flat knitting machine used to the present invention.
Figure 2B:
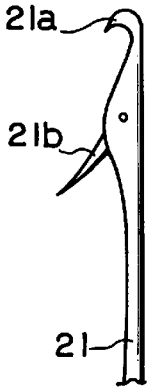
FIG. 2B is a side view showing a needle used for a flat knitting machine.

In the knit fabric B, the first half knitting portion of a right-going first course C1 is knitted using a preceding yarn carrier 11 which guides the first ground yarn 1 and a yarn carrier 11*c* which guides the plating yarn "c" and follows the yarn carrier 11 as shown in FIG. 2A. In the drawing, however, knitting is carried out in the direction of an arrow X and the first ground yarn 1 and the plating yarn "c" are simultaneously captured by needles 21, 21 . . . which sequentially move from a clearing position to a knit position on a needle bed 20. FIG. 2A shows guides 22, 22 . . . for guiding the needles 21, 21 . . . together with the hooks 21*a* and the latches 21*b* of the respective needles 21. However, the open state of the latches 21*b* is shown by hatching in FIG. 2A, an actual opening state of needle 21 is shown in FIG. 2B.

In FIG. 1, the second half knitting portion of the right-going course C1 is knitted by causing a yarn carrier 12, which guides the second ground yarn 2, to precede in place of the yarn carrier 11 which guides the first ground yarn 1. Further, it is sufficient only to knit the first half knitting portion of a next left-going course C2 by causing the yarn carrier 12, which guides the second ground yarn 2, to precede and the yarn carrier 11*c* which guides the plating yarn "c" to follow the yarn carrier 12 and it is sufficient only to knit the second half portion of the next course C2 by replacing the yarn carrier 12 with the yarn carrier 11 which guides the first ground yarn 1 to precede. The knit fabric B can be knitted by repeating the same procedure thereafter.

Figure 3:
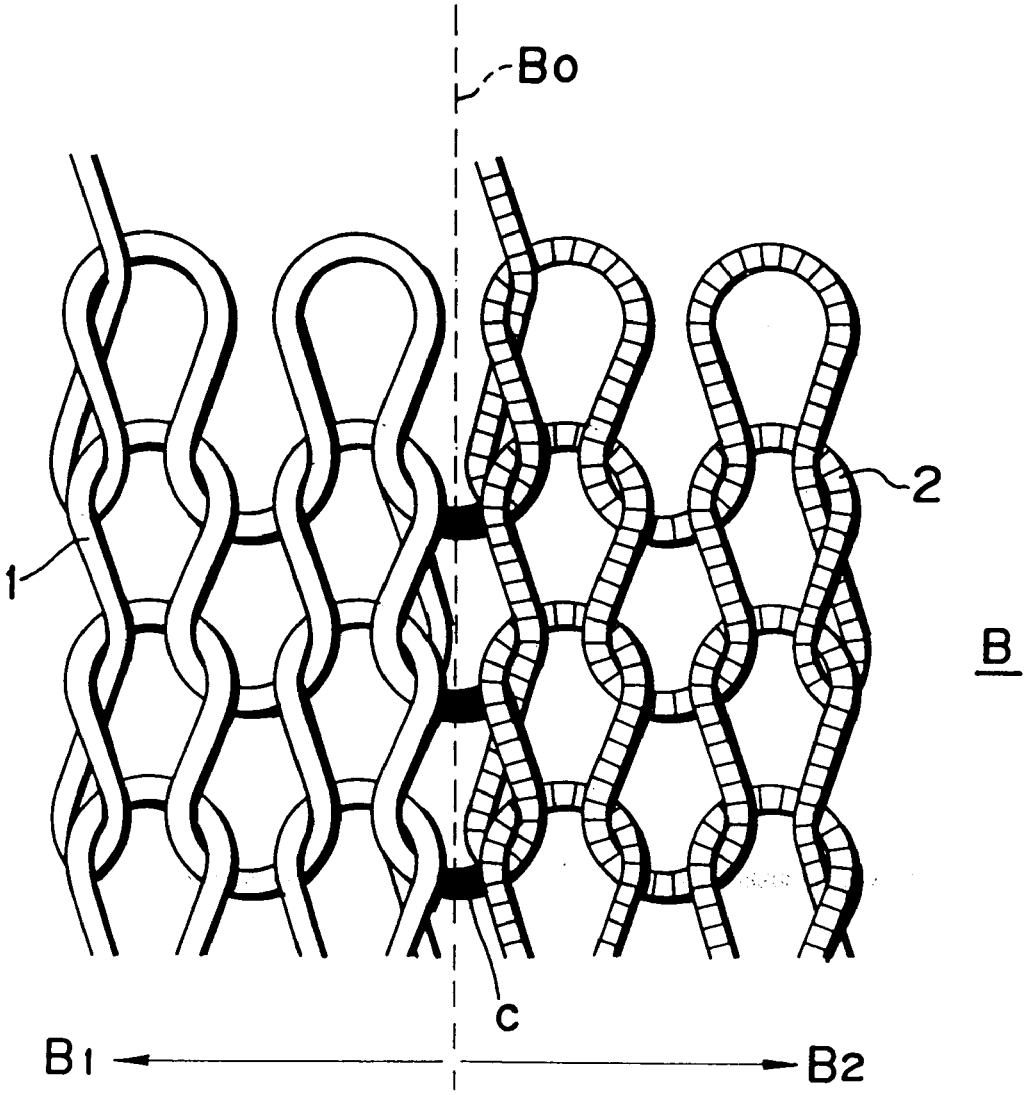
FIG. 3 is a view showing a stitched structure knitted by the present invention.

As shown in FIG. 3, since the first ground yarn 1 and the second ground yarn 2 appear as a front stitch on both the sides of the boundary B0 between each first half knitting portion and each second half knitting portion of the course C1 and the next course C2, that is, the boundary B0 between the first and second platingly stitched portions B1, B2, colored patterns of a clear tone of color can be formed on both sides of the boundary B0 in the first and the second platingly stitched portions B1, B2. Further, the first and second platingly stitched portions B1, B2 have the ground yarns 1 and 2 forming respective front stitches in the state that they completely separated from each other in the portion of the boundary B0 and these portions B1, B2 are coupled with each other through the common plating yarn "c" only to thereby form an intersia pattern.

Note that the boundary B0 between each first half knitting portion and each second half knitting portion of the course C1 and the next course C2 is not limited to the one which knits a vertically-striped straight pattern by being located at the same position in a wale direction as shown in FIG. 1 but may knit a vertically-striped oblique pattern or a diamond-shaped pattern by being shifted sequentially and regularly in the wale direction and moved to different positions. Further, a knit fabric having an arbitrary colored pattern such as a water-flow-shaped (S-shaped) vertically-striped pattern and the like may be knitted by smoothly changing the boundary in the wale direction and positioning it at different locations.

In the above description, the first and second platingly stitched portions B1, B2 may be formed to a rib stitched structure instead of the plainly stitched structure. In this case, the first ground yarn appears to the surface and the back of the first platingly stitched portion B1 as well as the second ground yarn 2 appears to the surface and the back of the second platingly stitched portion B2. Note, the rib stitched structure may be formed to any one of the first and second platingly stitched portions B1, B2 and the other of it may be formed to a plainly stitched structure. Further, the rib stitched structure and a pearl stitched structure may be mixed and combined with suitable courses of the first and second platingly stitched portions B1, B2 of the plainly stitched structure.

Figure 4:
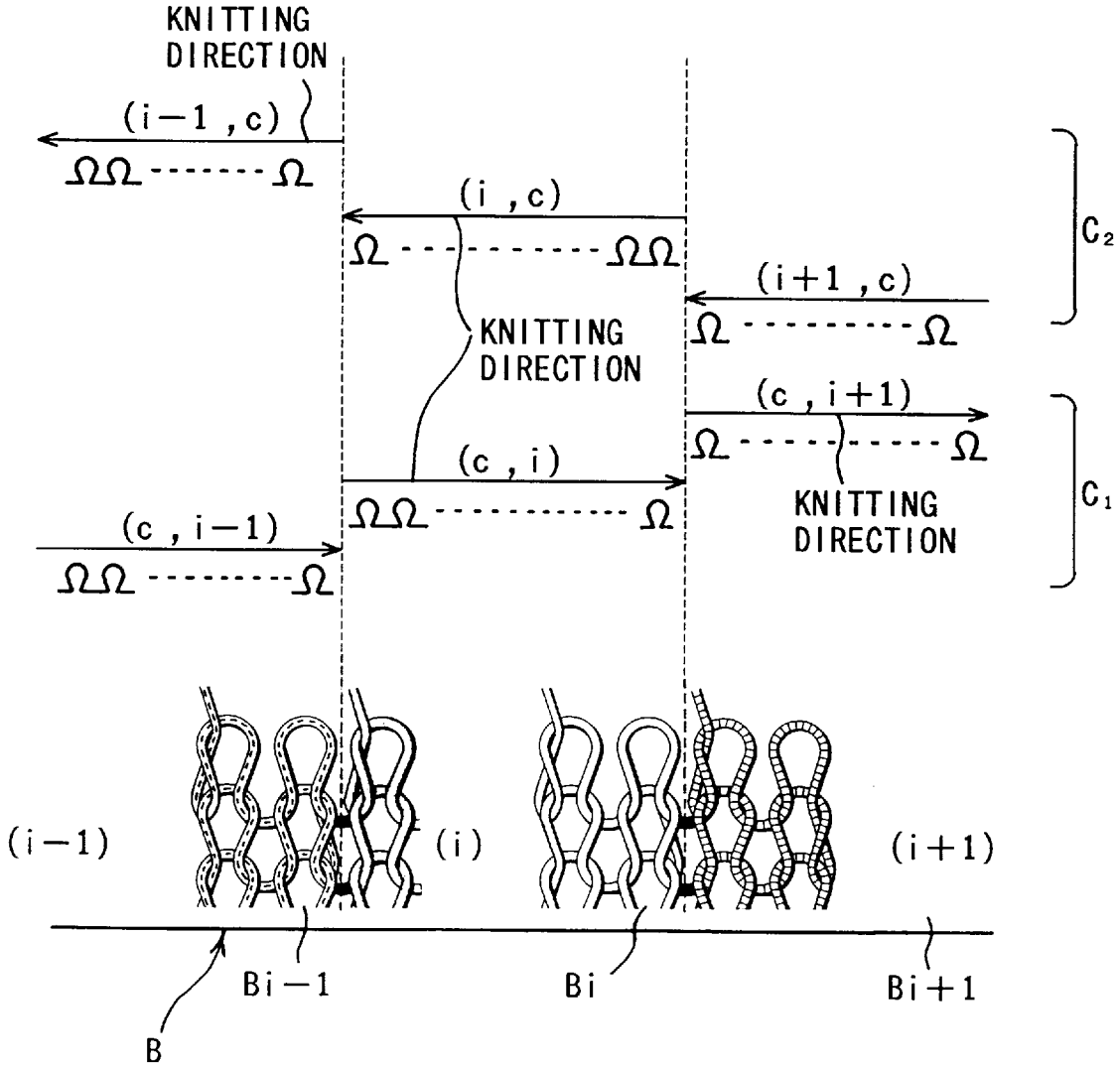
FIG. 4 is a schematic view showing another embodiment of the knitting method of the present invention.

FIG. 4 shows another embodiment of the knitting method of the present invention, wherein a first to n-th platingly stitched portions Bi(i=1, 2 . . . n) are formed to a knit fabric B. That is, it suffices for an i-th platingly stitched portion Bi to be knitted to a plating stitch by an i-th ground yarn i(i=1, 2 . . . n) and a common plating yarn "c" and at the time the i-th and j-th platingly stitched portions Bi and Bj which are not adjacent to each other (i≠j) can commonly use the i-th ground yarn i. Different from a jacquard structure, even if a multi-color vertically-striped pattern is knitted, since there is no other useless plating yarn but the plating yarn "c". Thus there is no chance that the thickness of the knit fabric B is unduly increased.

Note, in FIG. 4, the (i−1)-th and i-th platingly stitched portions Bi−1 and Bi and the i-th and (i+1)-th platingly stitched portions Bi and an Bi+1 which are adjacent to each other can be caused to individually correspond to the first and second platingly stitched portions B1, B2 of FIG. 1, respectively.

As described above, according to the knit fabric of the present invention, since the first and second ground yarns appear to the front stitch of the adjacent first and second platingly stitched portions respectively and they are coupled with each other through the common plating yarn, the respective portions forming the colored pattern has a uniform thickness and the colored pattern of the clear tone of color made by the intersia pattern can be realized. In addition to the above, a special stitched structure need not be interposed between the boundary portions and the entire portion of the knit fabric can be knitted in the plainly stitched structure; therefore, high productivity can be maintained.

Further, according to the knitting method of the present invention, the above knit fabric can be smoothly knitted by knitting the first half knitting portions and the second half knitting portions of the respective courses to the plating stitch by changing the combination of the first and second ground yarns and plating yarn.

Although the present invention has been fully described by way of examples with reference to the accompanied drawings, it is to be understood various changes and modifications will be apparent to those skilled in the art without departing from the spirit and the scope of the invention. Accordingly, the invention should not be limited by the foregoing description but rather should be defined only by the following claims.

What is claimed is:

1. A method of knitting a knit fabric being knitted by a flat knitting machine with at least three yarn carriers which comprise a first yarn carrier guiding a first ground yarn, a second yarn carrier guiding a second ground yarn, and a third yarn carrier guiding a plating yarn, the method comprising the steps of:

(a) knitting a first half knitting portion of a course to a plating stitch with a first ground yarn and a plating yarn by moving the first and third the yarn carriers, the first yarn carrier preceding the third yarn carrier in movement and the second yarn carrier being stationary;

(b) knitting a second half knitting portion of said course to a plating stitch with the second ground yarn and the plating yarn by moving the second and third yarn carriers, the second yarn carrier preceding the third yarn carrier in movement and the first yarn carrier being stationary;

(c) knitting a first half knitting portion of a next course to a plating stitch with said second ground yarn and said plating yarn by moving the second and third yarn carriers, the second yarn carrier preceding the third yarn carrier in movement and the first yarn carrier being stationary; and (d) knitting a second half knitting portion of the next course to a plating stitch with said first ground yarn and said plating yarn by moving the first and third yarn carriers, the first yarn carrier preceding the third yarn carrier in movement and the second yarn carrier being stationary.

2. A method of knitting a plating stitch according to claim 1, wherein boundaries formed between the first half knitting portions in said course and said next course and the second half knitting portions therein are aligned at the same position in a wale direction thereof.

3. A method of knitting a plating stitch according to claim 1, wherein boundaries formed between the first half knitting portions in said course and said next course and the second half knitting portions therein are set to different positions in a wale direction thereof.

4. A knit fabric, comprising:

a first plating stitched portion made by knitting a first ground yarn and a plating yarn, the first ground yarn appearing on a surface of the knit fabric and the plating yarn being hidden substantially underneath the first ground yarn; and a second platingly stitched portion located adjacent to the first platingly stitched portion in a flat direction and made by knitting a second ground yarn and said plating yarn, the second ground yarn appearing on the surface of the knit fabric and the plating yarn being hidden substantially underneath the second ground yarn;

wherein said first and second platingly stitched portions are coupled with each other in a course direction through said plating yarn only.

5. A knit fabric according to claim 4, wherein said first and second platingly stitched portions form a continuous plainly stitched structure.

6. A method of knitting a plating stitch according to claim 1, wherein the first half knitting portion includes a plurality of stitches made in a continuous manner by the first ground yarn and the plating yarn and wherein the second half knitting portion includes a plurality of stitches made in a continuous manner by the second ground yarn and the plating yarn.

7. A knit fabric according to claim 4, wherein the first platingly stitched portion includes a plurality of stitches made in a continuous manner by the first ground yarn and the plating yarn and wherein the second platingly stitched portion includes a plurality of stitches made in a continuous manner by the second ground yarn and the plating yarn.

* * * * *